US008834328B1

(12) United States Patent
Batca

(10) Patent No.: US 8,834,328 B1
(45) **Date of Patent: *Sep. 16, 2014**

(54) ADJUSTABLE FLEXIBLE LINE ENDS

(76) Inventor: Roger Batca, Durham, NC (US)

( * ) Notice: Subject to any disclaimer, the term of this patent is extended or adjusted under 35 U.S.C. 154(b) by 199 days.

This patent is subject to a terminal disclaimer.

(21) Appl. No.: 13/419,883

(22) Filed: Mar. 14, 2012

Related U.S. Application Data

(63) Continuation-in-part of application No. 12/695,234, filed on Jan. 28, 2010, now Pat. No. 8,172,733, which is a continuation-in-part of application No. 12/685,975, filed on Jan. 12, 2010, now abandoned, and a continuation-in-part of application No. 12/046,034, filed on Mar. 11, 2008, now Pat. No. 7,654,942.

(60) Provisional application No. 60/918,391, filed on Mar. 16, 2007.

(51) Int. Cl.
*A63B 21/00* (2006.01)

(52) U.S. Cl.
CPC ..... *A63B 21/00043* (2013.01)
USPC ..... 482/99; 482/93; 482/100

(58) Field of Classification Search
USPC ..... 482/99, 93, 92, 97, 98, 100, 101, 102
See application file for complete search history.

(56) References Cited

U.S. PATENT DOCUMENTS

| | | | | |
|---|---|---|---|---|
| 4,603,855 | A * | 8/1986 | Sebelle | 482/103 |
| 6,394,935 | B1 * | 5/2002 | Lake | 482/94 |
| 6,447,430 | B1 * | 9/2002 | Webb et al. | 482/98 |
| 6,527,683 | B2 * | 3/2003 | Tolles | 482/99 |
| 6,565,490 | B2 * | 5/2003 | O'Hearn | 482/102 |
| 7,070,546 | B1 * | 7/2006 | Grasso | 482/103 |
| 7,172,538 | B2 * | 2/2007 | Keiser | 482/140 |
| 7,654,942 | B1 * | 2/2010 | Batca | 482/99 |

* cited by examiner

*Primary Examiner* — Jerome W Donnelly
(74) *Attorney, Agent, or Firm* — Coats and Bennett, PLLC

(57) ABSTRACT

An exercise apparatus includes a flexible connector system that includes at least two flexible line ends that provide multiple resistance ratios for functional and strength training when pulled. The flexible line ends are adjustable to multiple fixed positions along a track and to multiple fixed positions along a curved path.

12 Claims, 11 Drawing Sheets

ADJUSTABLE FLEXIBLE LINE ENDS

RELATED APPLICATIONS

This application is a continuation-in-part (CIP) of U.S. patent application Ser. No. 12/695,234 filed Jan. 28, 2010 which is a continuation-in-part (CIP) of U.S. patent application Ser. No. 12/046,034 filed Mar. 11, 2008, now U.S. Pat. No. 7,654,942, which claims priority to Provisional Patent Application No. 60/918,391 filed Mar. 16, 2007, each of which is incorporated herein by reference in its entirety. U.S. patent application Ser. No. 12/695,234 filed Jan. 28, 2010 is also a continuation-in-part (CIP) of U.S. patent Ser. No. 12/685,975 filed on Jan. 12, 2010 which is now abandoned.

FIELD OF THE INVENTION

The present invention is directed generally to exercise equipment and, more particularly, an apparatus to perform user defined movements by pressing or pulling one or more handles connected to one or more adjustable cable or flexible line ends.

BACKGROUND

Exercising is well known as a basic need for maintaining a healthy life. A recent trend in fitness is known as functional training. This type of training allows an individual to grasp one or more handles of an exercise machine and press or pull in a motion defined by the user. This motion can reproduce sport specific movements of an athlete or reproduce everyday movements of an individual. User defined movements with resistance will engage numerous stabilizer and major muscles and help an individual achieve total body strength conditioning and overall better health.

One type of exercise machine used to perform functional training is an adjustable cable column. Typically, an adjustable cable column has a cable end with a handle assembly attached which can be pressed or pulled by a user. The cable end exits a swivel pulley assembly that is pivotally attached to a sleeve. This sleeve is linearly adjustable along a column enabling a user to engage a handle assembly at different starting positions for different exercises. The pivotally attached swivel pulley on the linearly adjustable sleeve allows the handle assembly to be pressed or pulled in multiple planes thus accommodating different sized users with different flexibilities and different training goals.

Typically, a weight stack provides the resistance for these adjustable cable columns. In order for the cable to maintain constant tension during the linear adjustment of a cable end along with a handle assembly, the cable is formed into a loop wherein each end of the cable is directed towards the linearly adjustable sleeve from opposite directions. One end of the cable is routed over at least one pulley on a swivel pulley assembly which is pivotally attached to a sleeve as previously described. The other end of the cable is also either tied into the same linearly adjustable sleeve or either routed over a second swivel pulley assembly which is pivotally attached to the same linearly adjustable sleeve. This same cable is also routed around one or two pulleys on top of the weight stack. When one or both ends of the cable assembly is pressed or pulled, the closed loop shortens, therefore lifting the selected weights in the weight stack and therefore providing resistance to the user.

The cable end of some adjustable cable columns are interconnected with the weight stack wherein a 4 to 1 mechanical advantage is provided to the user when one cable end is pressed or pulled. For example, if the adjustable cable column has a 200 lb weight stack and all 200 lbs are selected, pressing or pulling one cable end will provide 50 lbs of resistance. This is an advantage because the cable end can be pressed or pulled a long distance before the top of the weight stack will run out of upward travel distance. This allows the user to perform many functional training exercises that require long distance pressing or pulling and light weight resistance. This is a disadvantage if the user wants to perform strength training exercises that require shorter distance pressing or pulling and heavier weight resistance. An adjustable cable column could be made with a heavier weight stack such as 400 lbs but this would greatly increase the cost of the exercise machine.

The cable end of some adjustable cable columns are interconnected with the weight stack wherein a 2 to 1 mechanical advantage is provided to the user when one cable end is pressed or pulled. For example, if the adjustable cable column has a 200 lb weight stack and all 200 lbs are selected, pressing or pulling one cable end will provide 100 lbs of resistance. This 2 to 1 mechanical advantage does not allow as much cable end travel as the 4 to 1 mechanical advantage does because of the exercise machine height restrictions of the upward travel of the weight stack. The 2 to 1 ratio is an advantage if the user wants to perform strength training exercises that require shorter distance pressing or pulling and heavier weight resistance. The 2 to 1 ratio is a disadvantage if the user wants to perform some functional training exercises that require long distance pressing or pulling and light weight resistance.

U.S. patent application Ser. No. 12/046,034 filed Mar. 11, 2008, now U.S. Pat. No. 7,654,942, wherein Roger Batca is the inventor, teaches an exercise apparatus that includes one flexible connecting system that includes at least two flexible line ends that are linearly adjustable and which provide multiple resistance ratios for functional and strength training.

A second type of exercise machine for performing functional training exercise is called a functional trainer. A functional trainer typically has two adjustable arm assemblies that have a cable end exiting the distal end of each arm. A handle can be attached to each cable end on each arm and be pressed or pulled by a user. Each cable end is interconnected with a weight stack. Each cable end typically is routed over at least one pulley at the adjustable arm assembly's distal end. This pulley at the distal end of the adjustable arm assembly is typically pivotally attached to allow the handle to be pressed or pulled in multiple planes. The ability to press or pull in multiple planes and to engage a handle in selectively different starting positions accommodates different sized users with different flexibilities and different training goals.

Typically, one weight stack provides the resistance for these functional trainers. The cable end of the first adjustable arm assembly and the cable end of the second adjustable arm assembly are connected to the weight stack. The two cable ends of some functional trainers are interconnected with the weight stack wherein a 4 to 1 mechanical advantage is provided to the user when one cable end is pressed or pulled. For example, if the functional trainer has a 200 lb weight stack, pressing or pulling one cable end will provide 50 lbs of resistance. This is an advantage because the cable end can be pressed or pulled a long distance before the top of the weight stack will run out of upward travel distance. This allows the user to perform many functional training exercises that require long distance pressing or pulling and light weight resistance. This is a disadvantage if the user wants to perform strength training exercises that require shorter distance pressing or pulling and heavier weight resistance. A functional trainer could be made with a heavier weight stack such as 400 lbs but this would greatly increase the cost of the exercise machine.

The two cable ends of some functional trainers are interconnected with the weight stack wherein a 2 to 1 mechanical advantage is provided to the user when one cable end is pressed or pulled. For example, if the functional trainer has a 200 lb weight stack, pressing or pulling one cable end will provide 100 lbs of resistance. This 2 to 1 mechanical advantage does not allow as much cable end travel as the 4 to 1 mechanical advantage does because of the exercise machine height restrictions of the upward travel of the weight stack. The 2 to 1 ratio is an advantage if the user wants to perform strength training exercises that require shorter distance pressing or pulling and heavier weight resistance. The 2 to 1 ratio is a disadvantage if the user wants to perform some functional training exercises that require long distance pressing or pulling and light weight resistance.

U.S. patent application Ser. No. 12/019,174 filed Jan. 24, 2008, now U.S. Pat. No. 8,096,926, wherein Roger Batca is the inventor, teaches an exercise apparatus that includes one flexible connecting system that includes at least two flexible line ends that are pivotally adjustable and which provide multiple resistance ratios for functional and strength training.

An exercise apparatus that includes one flexible connecting system that includes at least two flexible line ends that are linearly and pivotally adjustable and which provide multiple resistance ratios for functional and strength training would allow additional starting points of engagement with a handle and provide more exercise versatility for a user.

SUMMARY

The present invention is directed to an exercise apparatus that includes one flexible connecting system that includes at least two flexible line ends that provide multiple resistance ratios for functional and strength training. The flexible line ends, which can be connected with a handle for pulling, can be selectively positioned to accommodate a user's preferred point of engagement. The exercise apparatus comprises a frame, a track, a carriage assembly which is adjustable to multiple fixed positions along the track, a flexible connecting system which includes at least two flexible line ends coupled to the carriage assembly, and a resistance element. The carriage assembly includes a tracking assembly that is adjustable along the track, an arm assembly that is pivotally attached to the tracking assembly, and at least one swivel pulley assembly pivotally attached to the arm assembly. The two flexible line ends exit respective pulleys mounted to a respective swivel pulley assembly wherein a handle or other attachment can be connected to one or more of the flexible line ends. The flexible connecting system connects the resistance element to the handle or other attachment. In one exemplary embodiment, the resistance element is a weight stack and the flexible connecting system is a cable system.

In one exemplary embodiment, one cable system includes two cable ends that are adjustable along a track to multiple fixed positions as well as being pivotally adjustable to multiple fixed positions. The pulling of a first cable end will provide a different ratio of resistance than the pulling of a second cable end. For example, the first cable end is interconnected with a weight stack wherein pulling the first cable end will provide a 4 to 1 ratio of resistance to a user. The second cable end is interconnected with the weight stack wherein pulling the second cable end will provide a 2 to 1 ratio of resistance to the user.

In an alternate embodiment, one cable system includes two cable ends that are adjustable along a track to multiple fixed positions as well as being pivotally adjustable to multiple fixed positions. The pulling of a first cable end will provide the same ratio of resistance as the pulling of a second cable end. For example, the first cable end is interconnected with a weight stack wherein pulling the first cable end will provide a 4 to 1 ratio of resistance to a user. The second cable end is interconnected with the weight stack wherein pulling the second cable end will provide a 4 to 1 ratio of resistance to the user. Both cable ends can be connected with one handle and pulled together to provide an alternate ratio of resistance, as in this embodiment, the ratio of resistance would be 2 to 1.

Other aspects of the invention will become apparent in the detailed description.

DETAILED DESCRIPTION

Figure 1:
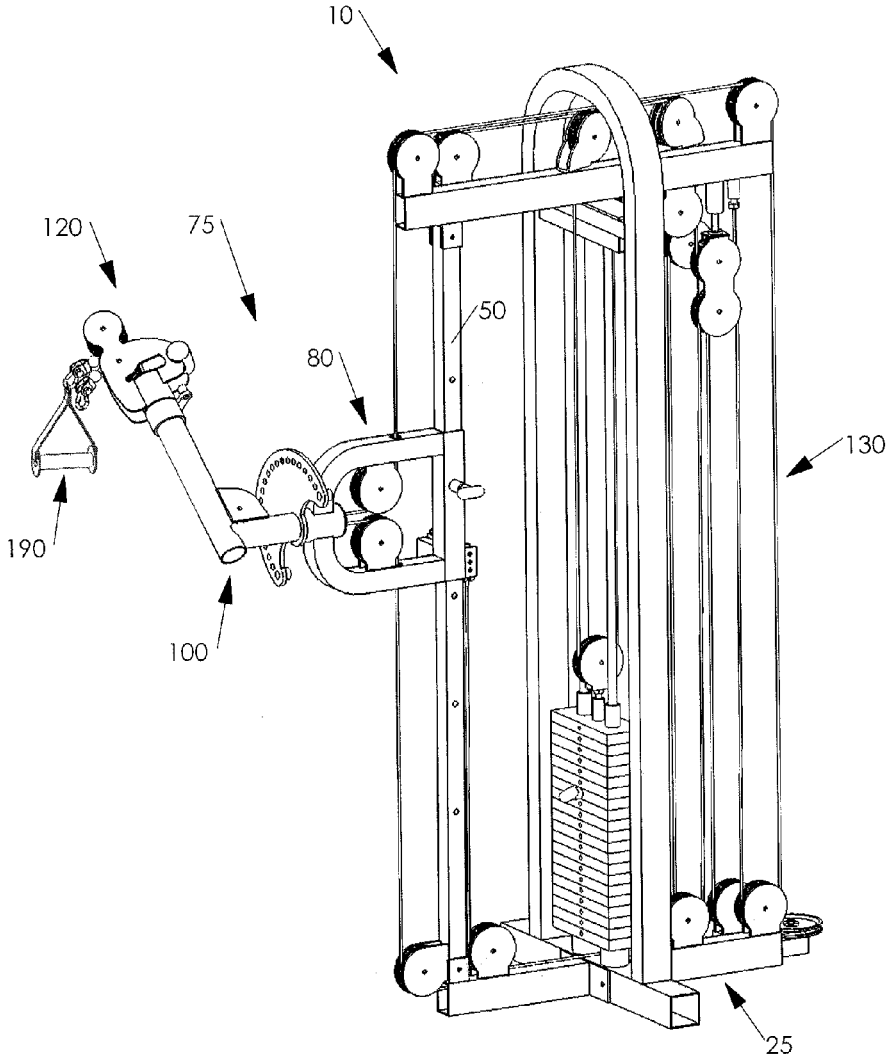
FIG. 1 is a perspective view illustrating an exemplary exercise apparatus according to the present invention from the front left side.
Figure 1:
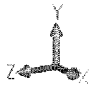

The embodiments illustrated in the drawings are for an exercise apparatus that includes one flexible connecting system that includes at least two flexible line ends that provide multiple resistance ratios for functional and strength training. The flexible line ends, which can be connected with a handle for pulling, can be selectively positioned to accommodate a user's preferred point of engagement. A user can pull the desired flexible line end or ends based on whether they need lighter resistance and more flexible line end travel for functional training movements or heavier resistance and less flexible line end travel for strength training movements.

Referring now to the drawings, one exemplary and one alternate embodiment of an exercise apparatus according to the present invention will be described and indicated generally by the numerals 10 and 210. Each above mentioned embodiment comprises a resistance element and will be described and indicated generally be the numeral 15. An exercise apparatus 10 and 210 also comprises a frame 25 and 225, an adjustable carriage assembly 75 and 275, and a flexible connecting system 130 and 330 interconnecting at least one handle assembly 190 to the resistance element 15.

In the exemplary and alternate embodiments, the resistance element 15 is a weight stack which is illustrated in FIGS. 1, 2, 5, and 6. Weight stacks are commonly used as a resistance element in the art of strength training. Those skilled in the art will appreciate that other resistance devices, such as electronic resistance devices, magnetic breaks, hydraulic cylinders, elastic bands, free weights, or pneumatic resistance may also be used to practice the present invention.

Figure 9:
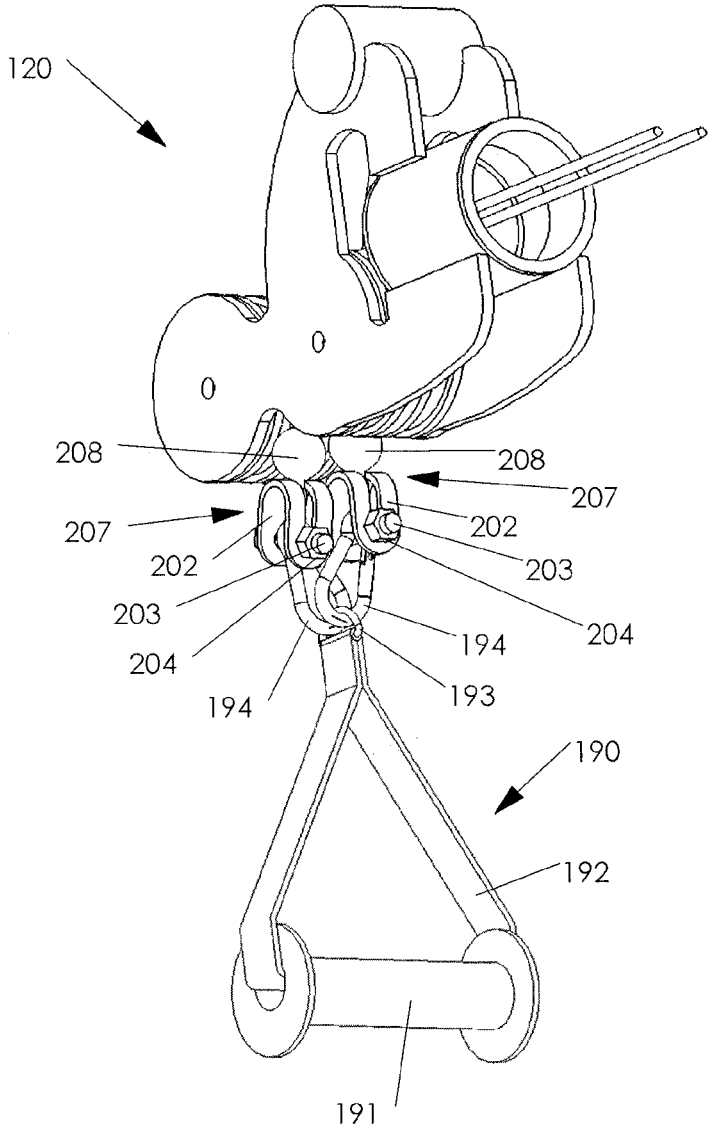
FIG. 9 is a perspective view illustrating one swivel pulley assembly wherein two cable ends are connected to one exemplary handle.
Figure 9:
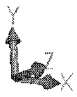

The flexible connecting system 130 and 330 interconnects the weight stack 15 with at least one handle assembly 190. FIG. 9 illustrates a handle assembly 190 which comprises a handle 191, a strap 192, a buckle 193, and a snap hook 194. Those skilled in the art will appreciate that there are many different types of handle assemblies not shown that can be used to practice the invention. A cable system 130 and 330 will be described as interconnecting the weight stack 15 with at least one handle assembly 190 in the exemplary and alternate embodiment of the exercise apparatus 10 and 210. FIG. 9 illustrates an exemplary embodiment of a cable end assembly 207 used on the ends of cables used within cable system 130 and 330. Cable end assembly 207 comprises small stop member 208, a small stop member retainer (not shown), a shank (not shown), strap 202, bolt 203, and nut 204. Those skilled in the art will appreciate that other flexible connecting systems such as belts, chains, cords, or rope may be used to practice the present invention. Also, those skilled in the art will appreciate that there are many different cable end assemblies that can be used to provide a rest position for a cable end as well as attachment means for a handle assembly.

Figure 2:
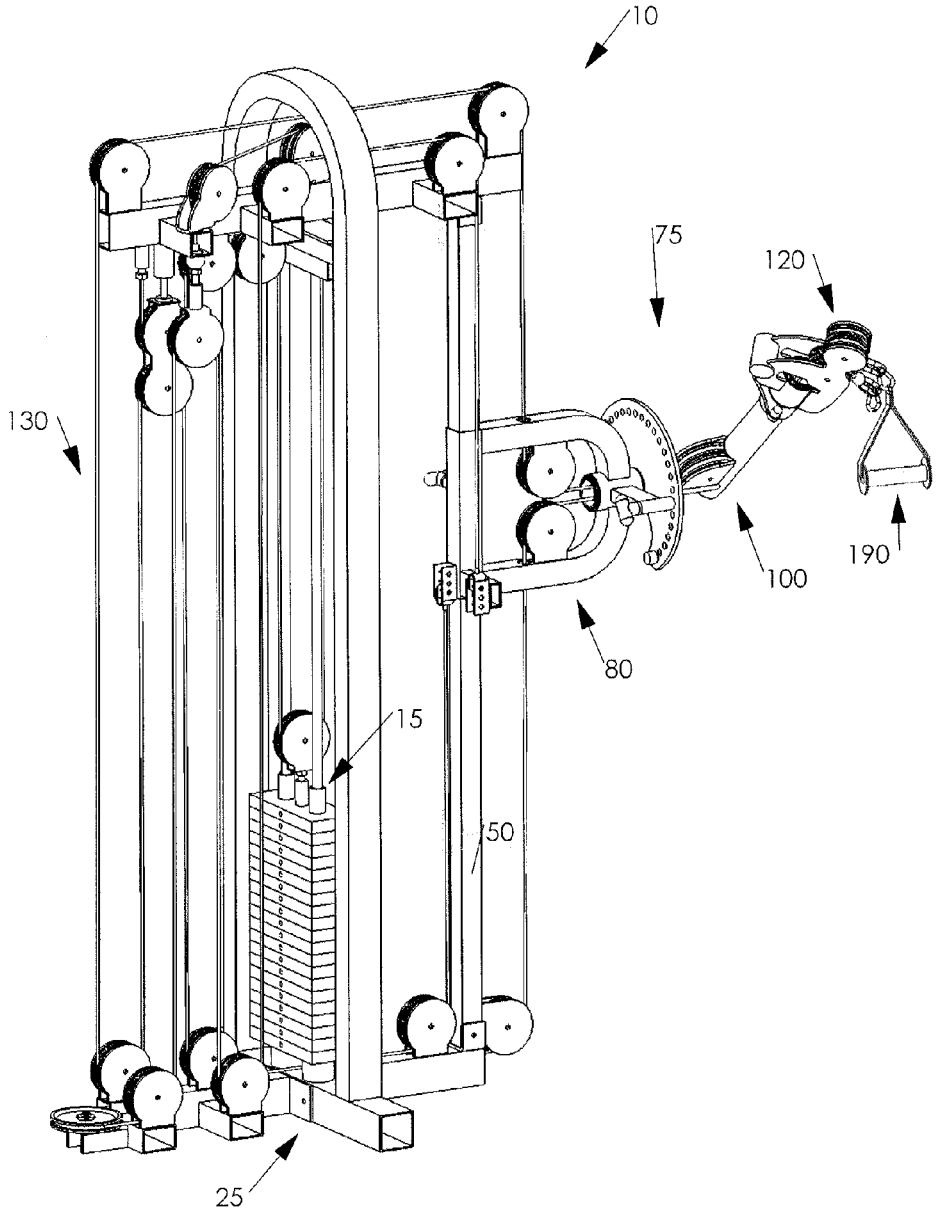
FIG. 2 is a perspective view illustrating an exemplary exercise apparatus according to the present invention from the back right side.
Figure 2:
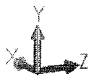

FIGS. 1 and 2 illustrate an exemplary exercise apparatus 10 which comprises a weight stack 15 to provide resistance, a frame 25, carriage assembly 75, cable system 130, and handle assembly 190. FIG. 1 illustrates exercise apparatus 10 from the front left side wherein carriage assembly 75 is adjusted to fixed positions including a fixed position along track 50. FIG. 2 illustrates exercise apparatus 10 from the back right side wherein carriage assembly 75 is adjusted to fixed positions including a fixed position along track 50.

In the exemplary embodiment the frame 25, illustrated in FIGS. 1 and 2, provides structural support and stability to the exercise apparatus 10. The frame 25 also provides connection points for the resistance element 15, cables and pulleys within flexible connecting system 130, and includes a track 50 for carriage assembly 75 to adjust on.

Figure 4:
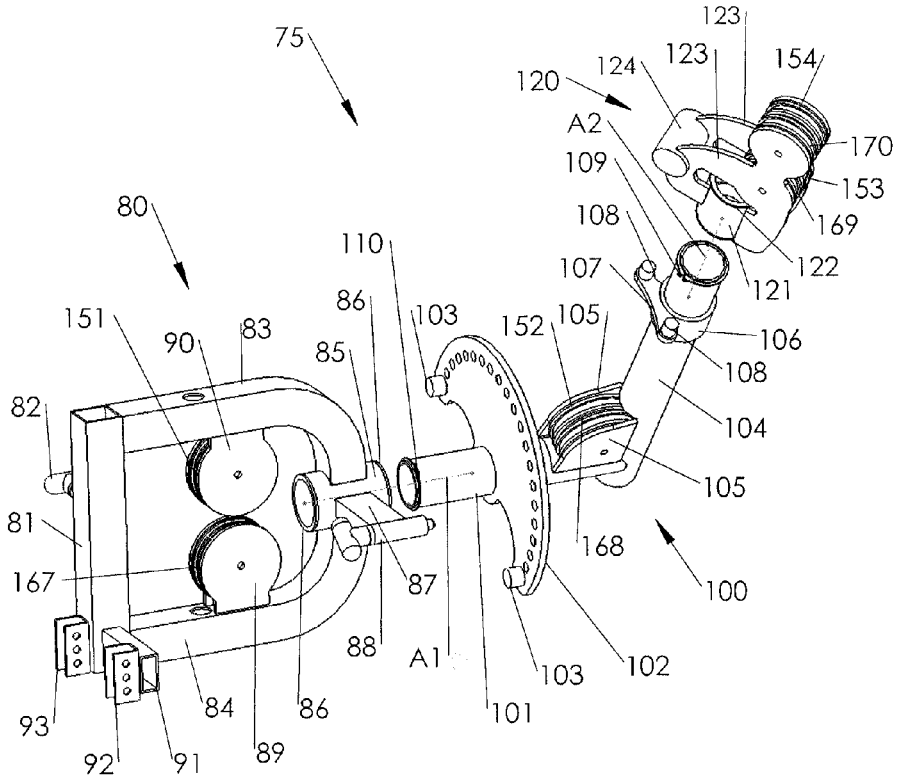
FIG. 4 is a perspective view illustrating an exemplary adjustable carriage assembly.

In the exemplary embodiment, the exercise apparatus 10 comprises carriage assembly 75. As illustrated in FIG. 4, carriage assembly 75 includes track assembly 80, arm assembly 100, and swivel pulley assembly 120.

A track assembly 80 comprises sleeve 81 which forms a perimeter around track 50 and slidingly retains the carriage assembly 75 onto the exercise apparatus 10. Locking pin 82 is attached to one side of sleeve 81 and secures the carriage assembly 75 into the desired location along track 50. Bent tubes 83 and 84 are attached to sleeve 81 on one respective end and are attached to bushing tube 85 on the other respective end. Bushing tube 85 includes a bushing 86 at each end wherein arm assembly 100 pivotally attaches and is rotatable about an axis labeled A1. Pulley plates 90 are attached to bent tube 83 and retain pulley 151. Pulley plates 89 are attached to bent tube 84 and retain pulley 167. Extension tube 87 is attached at one end to bushing tube 85 and to locking pin 88 at the other end. Locking pin 88 secures arm assembly 100 to multiple fixed positions as arm assembly 100 is rotatable about axis A1. Cable tie in bracket 93 is attached to sleeve 81 and secures one end of a cable within cable system 130. Extension tube 91 is attached to sleeve 81 at one end and is also attached at the other end to cable tie in bracket 92 which secures one end of a cable within cable system 130.

An arm assembly 100, as shown in FIG. 4, comprises side pivot tube 101 wherein a first end provides the pivot point for mounting arm assembly 100 onto bushings 86 of bushing tube 85 on track assembly 80 and is rotatable about an axis labeled A1. Extension tube 104 is attached near the other end of side pivot tube 101 and pulley plates 105 are attached in the corner where extension tube 104 and side pivot tube 101 meet. Pulley plates 105 secure pulleys 152 and 168. A locking plate 102, with apertures formed therein, is attached near the middle of side pivot tube 101. Locking pin 88 of track assembly 80 engages the desired aperture of locking plate 102 to secure the arm assembly 100 into the desired position. Bumpers 103 are attached generally at opposite sides of locking plate 102 and bumper against locking pin 88 of track assembly 80 to prevent over rotation of arm assembly 100. Sleeve stop 106 is attached near the distal end of extension tube 104 and prevents swivel pulley assembly 120 from sliding down extension tube 104. Bumpers 108 are attached to bumper plate 107 which is attached to sleeve stop 106 and prevent over rotation of swivel pulley assembly 120. Retaining ring 109 secures the swivel pulley assembly 120 to the arm assembly 100. Retaining ring 110 secures arm assembly 100 onto bushing tube 85 of track assembly 80.

A swivel pulley assembly 120, as shown in FIG. 4, is pivotally attached to arm assembly 100 and is rotatable about an axis labeled A2. A swivel pulley assembly 120 comprises bushing tube 121 which has respective bushings 122 at each end and which provides the pivot point for mounting onto extension tube 104. Swivel pulley assembly 120 also includes pulley plates 123, which are attached to bushing tube 121, and which also secure pulleys 153, 154, 169, and 170. Counter weight 124 is attached to pulley plates 123 and balances the weight of the swivel pulley assembly 120 about axis A2.

Figure 3:
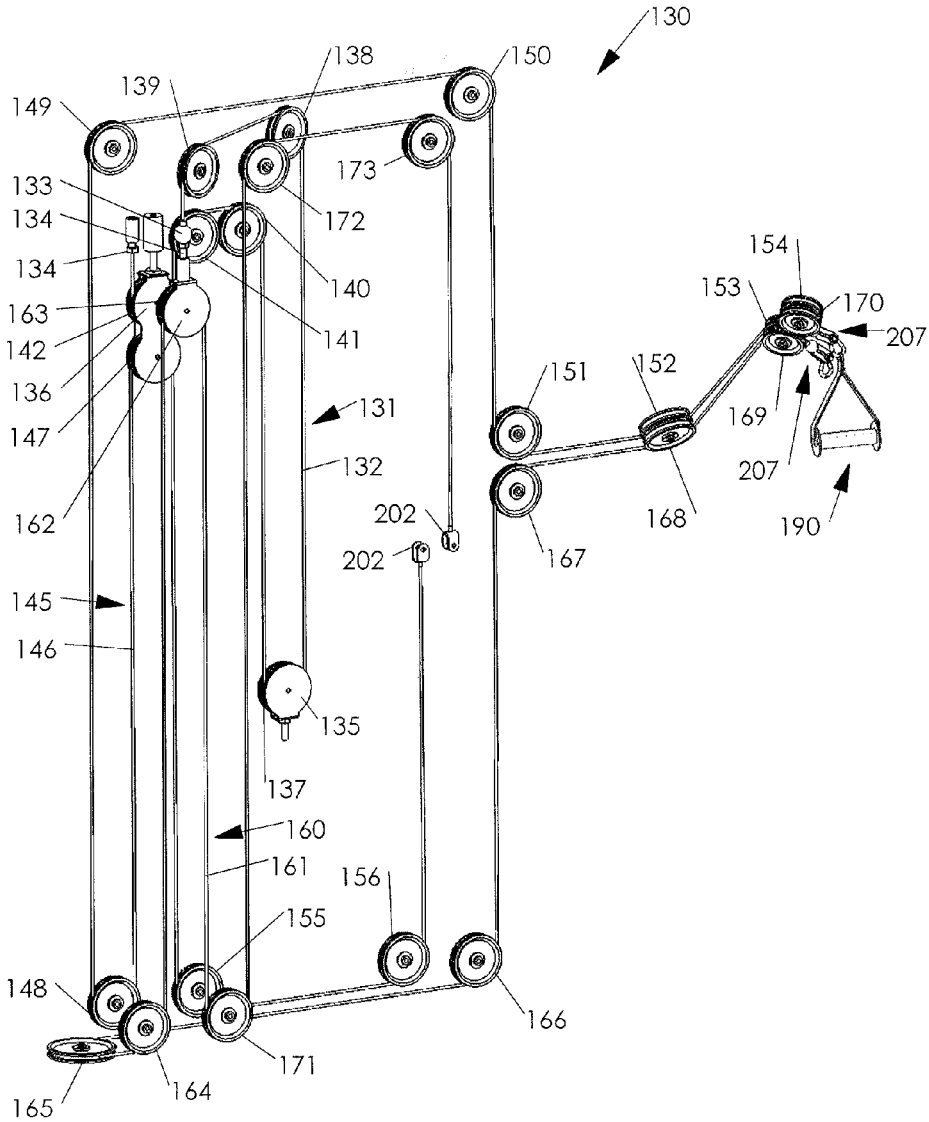
FIG. 3 is a perspective view illustrating the cable and pulley system of an exemplary exercise apparatus according to the present invention from the back right side.

In the exemplary embodiment, as illustrated in FIG. 3, cable system 130 includes cable assembly 131, cable assembly 145, cable assembly 160, weight stack pulley bracket 135, double pulley free floater 136, and single pulley free floater 162. Cable assembly 131 is directly connected with the weight stack 15 and serves as a main cable sector wherein cable assemblies 131, 145, and 160 can tap into and interconnect with resistance.

Cable assembly 131 comprises cable 132 which includes stop member 133 and cable bolt 134 attached at one end and cable bolt 134 attached at the other end. Cable 132 is routed through frame 25 then over fixed pulleys 139 and 138, then downward and around pulley 137 in weight stack pulley bracket 135. Cable 132 is then routed upwards and over fixed pulleys 140 and 141, then downwards and around pulley 142 in double pulley free floater 136. This end of cable 132 is then retained by frame 25. Frame 25 prohibits upward travel of the other end of cable 132 by bracing against stop member 133.

Cable assembly 145 comprises cable 146 which includes cable end assembly 200 attached at one end and cable end assembly 202 attached at the other end. Generally, the middle section of cable 146 is routed around pulley 147 in double pulley free floater 136. Respective sides of cable 146 are then routed downward and around fixed pulleys 148 and 155. After passing fixed pulley 148, this side of cable 146 is then routed upward and around fixed pulley 149, then outward and around fixed pulley 150. Cable 146 is then routed downward and around pulley 151 which is attached to carriage assembly 75. Cable 146 is then routed around pulley 152 which is attached to arm assembly 100. Cable 146 is then routed around pulley 153 which is attached to swivel pulley assembly 120. This is where one end of cable assembly 145 exits carriage assembly 75. Cable end assembly 200 bumpers against swivel pulley assembly 120 and provides this end of cable 146 a rest position when not in use as well as an attachment point for handle assembly 190. After passing fixed pulley 155, the other side of cable 146 is then routed outward and around fixed pulley 156. Cable 146 is then routed upward and then tied into carriage assembly 75. Cable end assembly 202 secures this end of cable 146 into cable tie in bracket 93. Both ends of cable 146 are routed towards carriage assembly 75 from opposite directions therefore closing cable 146 into a loop wherein cable assembly 145 will maintain a substantially constant tension when carriage assembly 75 is adjusted along track 50 into a desired fixed position. Pulley 154 serves as a guide pulley when one end of cable assembly 145 is pulled. When one end of cable assembly 145 is pulled, double pulley free floater 136 is pulled downward which causes cable assembly 131 to lift weight stack 15 therefore providing a 2 to 1 mechanical advantage to the user. Those skilled in the art will appreciate that the other end of cable 146 could also be made to exit a swivel pulley assembly for pulling by a user rather than being fixedly tied into carriage assembly 75.

Cable assembly 160 comprises cable 161 which includes cable end assembly 200 attached at one end and cable end assembly 202 attached at the other end. Generally, the middle section of cable 161 is routed around pulley 163 in single pulley free floater 162. Respective sides of cable 161 are then routed downward and around fixed pulleys 164 and 171. After passing fixed pulley 164, this side of cable 161 is then routed outward and around fixed pulley 165, then outward and around fixed pulley 166. Cable 161 is then routed upward and around pulley 167 which is attached to carriage assembly 75. Cable 161 is then routed around pulley 168 which is attached to arm assembly 100. Cable 161 is then routed around pulley 169 which is attached to swivel pulley assembly 120. This is where one end of cable assembly 160 exits carriage assembly 75. Cable end assembly 200 bumpers against swivel pulley assembly 120 and provides this end of cable 161 a rest position when not in use as well as an attachment point for handle assembly 190. After passing fixed pulley 171, the other side of cable 161 is then routed upward and around fixed pulley 172. Cable 161 is then routed outward and around fixed pulley 173. Cable 161 is then routed downward and then tied into carriage assembly 75. Cable end assembly 202 secures this end of cable 161 into cable tie in bracket 92. Both ends of cable 161 are routed towards carriage assembly 75 from opposite directions therefore closing cable 161 into a loop wherein cable assembly 160 will maintain a substantially constant tension when carriage assembly 75 is adjusted along track 50 into the desired fixed position. Pulley 170 serves as a guide pulley when one end of cable assembly 160 is pulled. When one end of cable assembly 160 is pulled, single pulley free floater 162 is pulled downward which causes cable assembly 131 to lift weight stack 15 therefore providing a 4 to 1 mechanical advantage to the user. Those skilled in the art will appreciate that the other end of cable 161 could also be made to exit a swivel pulley assembly for pulling by a user rather than being fixedly tied into carriage assembly 75.

To exercise with exercise apparatus 10, a user will attach handle assembly 190 to the cable end assembly 200 which will best suit their exercising objectives based on the amount of cable travel and the ratio of resistance needed. The user will then adjust carriage assembly 75 by unlocking locking pin 82 and by relocking locking pin 82 into the desired aperture in track 50 based on the desired starting pulling point of cable end assemblies 200. The user will also pivotally adjust arm assembly 100 by unlocking locking pin 88 on track assembly 80 and by relocking locking pin 88 into the desired aperture in locking plate 102 on arm assembly 100 based on the desired starting pulling point of cable end assemblies 200. The user will then select the appropriate amount of resistance from weight stack 15. The user will then pull handle assembly 190 to perform one of many known exercises in the art. As the user exercises, swivel pulley assembly 120 will pivot into the direction the user is pulling thus allowing smooth user defined movements. In this embodiment, if one end of cable assembly 145 is pulled, the user will receive a 2 to 1 ratio or resistance (mechanical advantage). If one end of cable assembly 160 is pulled, the user will receive a 4 to 1 ratio of resistance (mechanical advantage). A lower ratio of resistance will provide less resistance and also allow more cable end travel which is typically needed for functional training exercises. A higher ratio of resistance will provide more resistance for strength training movements wherein long cable end travel is not required.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Alternate carriage assemblies and tracks could be used such as carriage assemblies that track on roller wheels or roller bearings. Also, each cable end assembly could have its own respective handle assembly, one handle assembly could attach to either cable end assembly, or one handle assembly could attach to one or both cable end assemblies together to provide an additional ratio of resistance. Also, a handle assembly could specifically attach to one cable end assembly and a handle assembly could specifically attach to multiple cable end assemblies.

Figure 5:
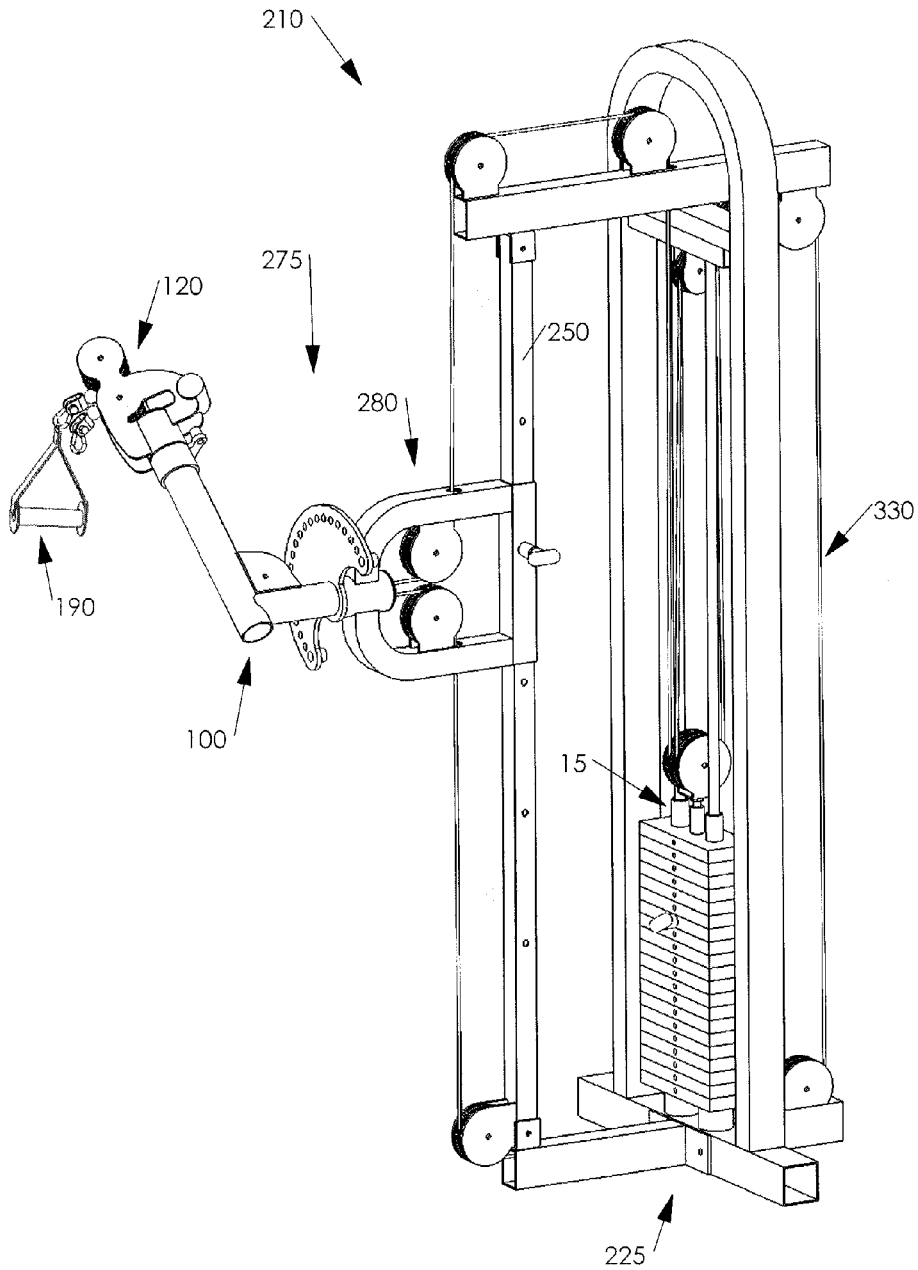
FIG. 5 is a perspective view illustrating an alternate embodiment exercise apparatus from the front left side.
Figure 5:
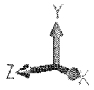
Figure 6:
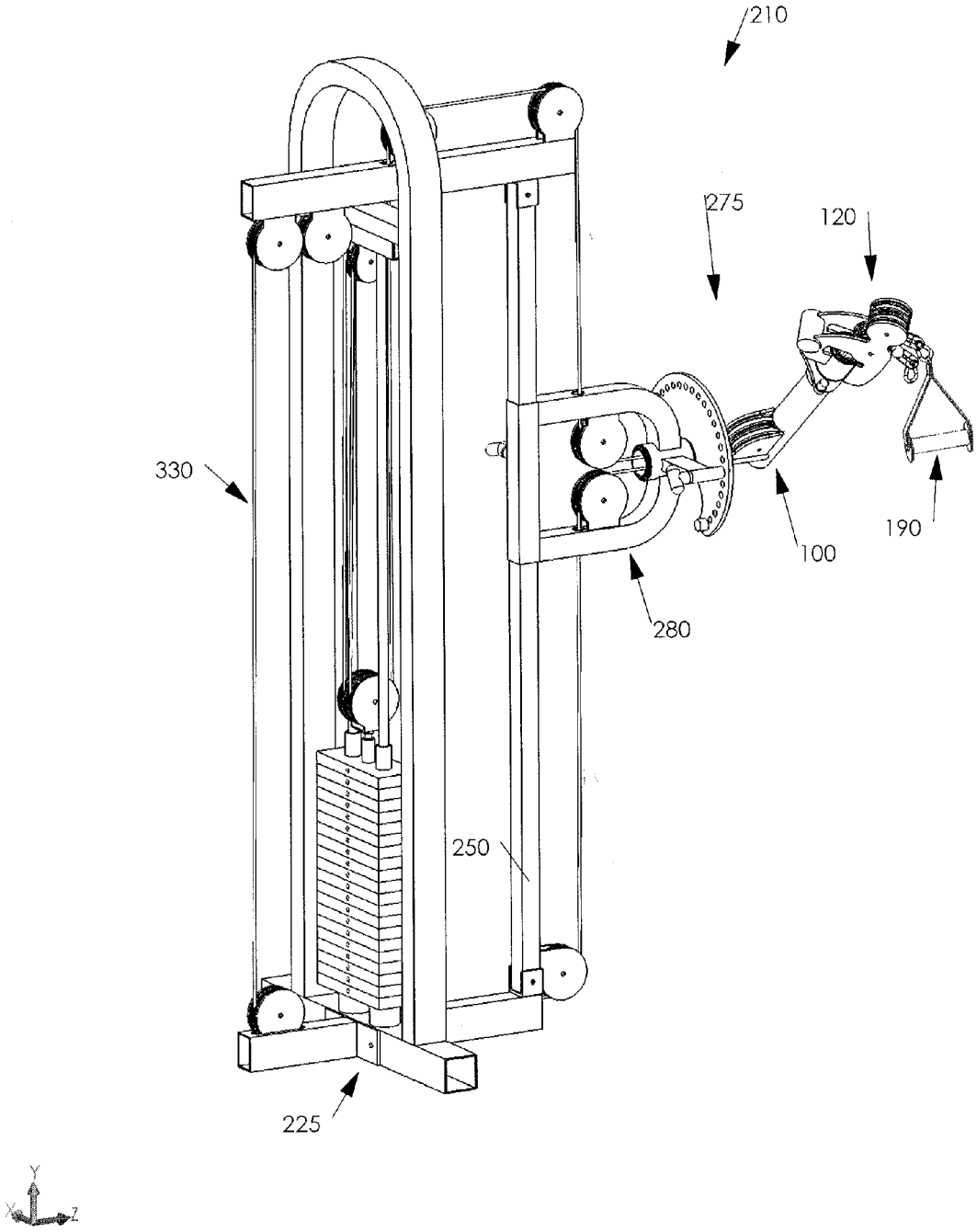
FIG. 6 is a perspective view illustrating an alternate embodiment exercise apparatus from the back right side.

FIGS. 5 and 6 illustrate an alternate embodiment exercise apparatus which is generally indicated by the numeral 210 and which comprises a weight stack 15 to provide resistance, a frame 225, carriage assembly 275, cable system 330, and handle assembly 190. FIG. 5 illustrates exercise apparatus 210 from the front left side wherein carriage assembly 275 is adjusted to fixed positions including a fixed position along track 250. FIG. 6 illustrates exercise apparatus 210 from the back right side wherein carriage assembly 275 is adjusted to fixed positions including a fixed position along track 250.

In the alternate embodiment the frame 225, illustrated in FIGS. 1 and 2, provides structural support and stability to the exercise apparatus 210. The frame 225 also provides connection points for the resistance element 15, cables and pulleys within flexible connecting system 330, and includes a track 250 for carriage assembly 275 to adjust on.

Figure 8:
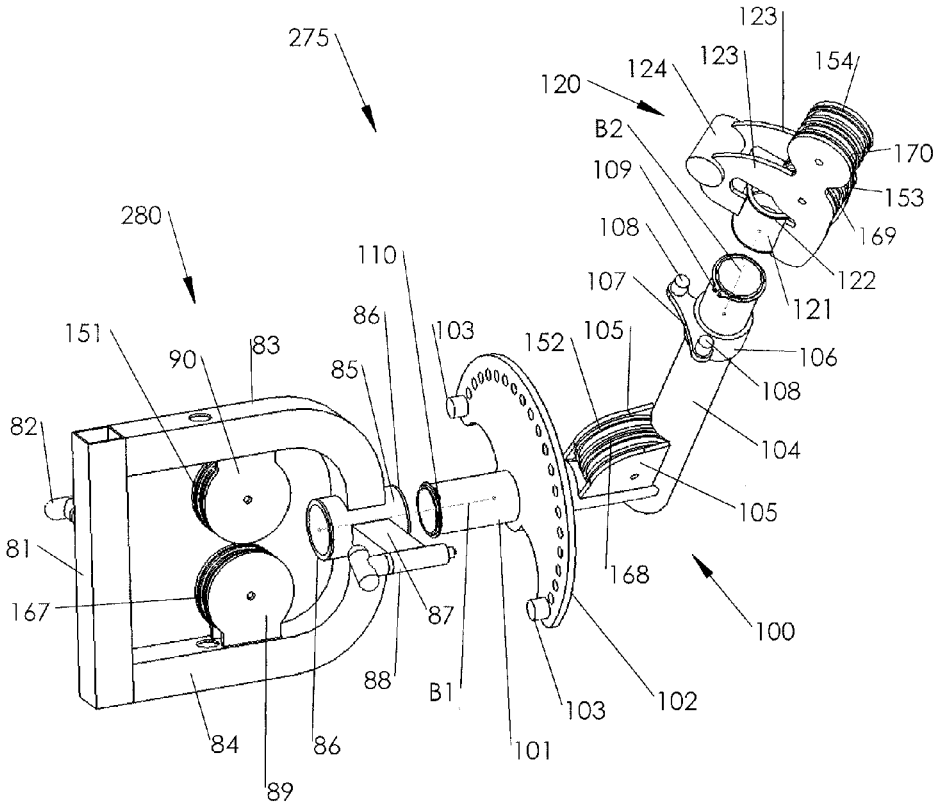
FIG. 8 is a perspective view illustrating an alternate embodiment adjustable carriage assembly.

In the alternate embodiment, the exercise apparatus 210 comprises carriage assembly 275. As illustrated in FIG. 8, carriage assembly 275 includes track assembly 280, arm assembly 100, and swivel pulley assembly 120.

A track assembly 280 comprises sleeve 81 which forms a perimeter around track 250 and slidingly retains the carriage assembly 275 onto the exercise apparatus 210. Locking pin 82 is attached to one side of sleeve 81 and secures the carriage assembly 275 into the desired location along track 250. Bent tubes 83 and 84 are attached to sleeve 81 on one respective end and are attached to bushing tube 85 on the other respective end. Bushing tube 85 includes a bushing 86 at each end wherein arm assembly 100 pivotally attaches and is rotatable about an axis labeled B1. Pulley plates 90 are attached to bent tube 83 and retain pulley 151. Pulley plates 89 are attached to bent tube 84 and retain pulley 167. Extension tube 87 is attached at one end to bushing tube 85 and to locking pin 88 at the other end. Locking pin 88 secures arm assembly 100 to multiple fixed positions as arm assembly 100 is rotatable about axis B1.

An arm assembly 100, as shown in FIG. 8, comprises side pivot tube 101 wherein a first end provides the pivot point for mounting arm assembly 100 onto bushings 86 of bushing tube 85 on track assembly 280 and is rotatable about an axis labeled B1. Extension tube 104 is attached near the other end of side pivot tube 101 and pulley plates 105 are attached in the corner where extension tube 104 and side pivot tube 101 meet. Pulley plates 105 secure pulleys 152 and 168. A locking plate 102, with apertures formed therein, is attached near the middle of side pivot tube 101. Locking pin 88 of track assembly 280 engages the desired aperture of locking plate 102 to secure the arm assembly 100 into the desired position. Bumpers 103 are attached generally at opposite sides of locking plate 102 and bumper against locking pin 88 of track assembly 280 to prevent over rotation of arm assembly 100. Sleeve stop 106 is attached near the distal end of extension tube 104 and prevents swivel pulley assembly 120 from sliding down extension tube 104. Bumpers 108 are attached to bumper plate 107 which is attached to sleeve stop 106 and prevent over rotation of swivel pulley assembly 120. Retaining ring 109 secures the swivel pulley assembly 120 to the arm assembly 100. Retaining ring 110 secures arm assembly 100 onto bushing tube 85 of track assembly 280.

A swivel pulley assembly 120, as shown in FIG. 8, is pivotally attached to arm assembly 100 and is rotatable about an axis labeled B2. A swivel pulley assembly 120 comprises bushing tube 121 which has respective bushings 122 at each end and which provides the pivot point for mounting onto extension tube 104. Swivel pulley assembly 120 also includes pulley plates 123, which are attached to bushing tube 121, and which also secure pulleys 153, 154, 169, and 170. Counter weight 124 is attached to pulley plates 123 and balances the weight of the swivel pulley assembly 120 about axis B2.

Figure 7:
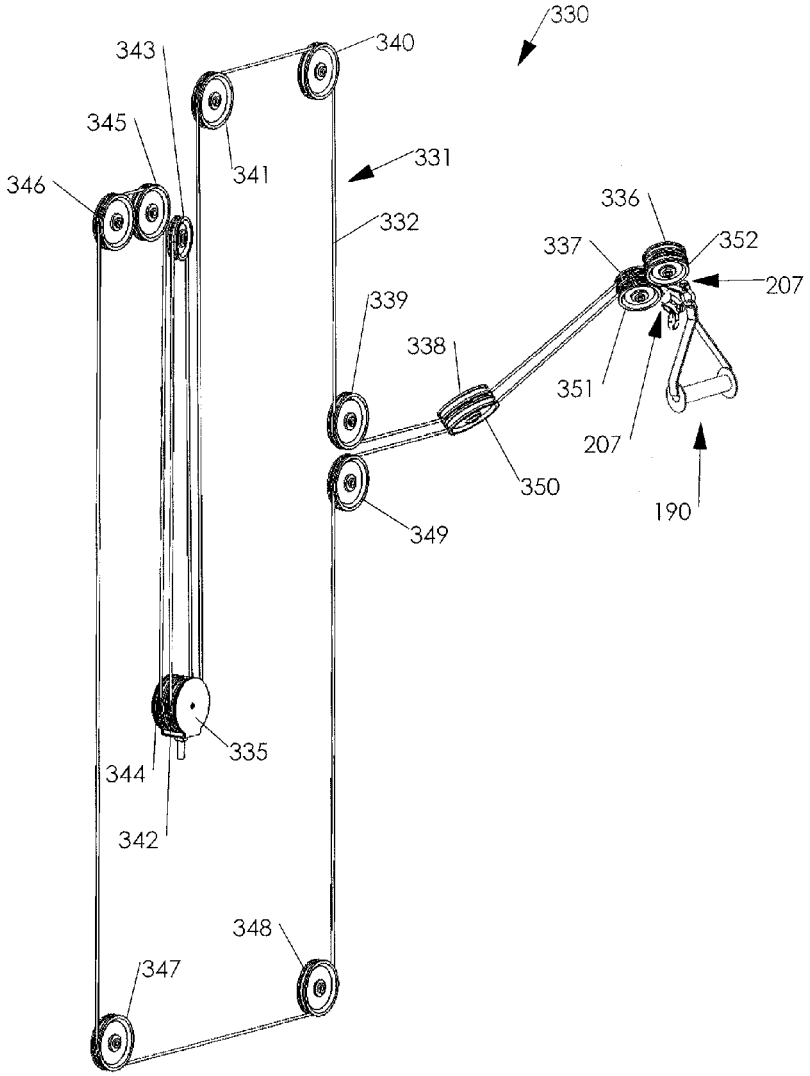
FIG. 7 is a perspective view illustrating the cable and pulley system of an alternate embodiment exercise apparatus from the back right side.
Figure 7:
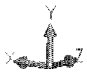

In this alternate embodiment, as illustrated in FIG. 7, cable system 330 includes cable assembly 331, and weight stack pulley bracket 335.

Cable assembly 331 is directly connected with the weight stack 15 and comprises cable 332 which includes cable end assembly 200 attached at one end and cable end assembly 200 attached at the other end. Both ends exit swivel pulley assembly 120 and each respective cable end assembly 200 bumpers against swivel pulley assembly 120 and provides each end of cable 332 a rest position when not in use as well as an attachment point for handle assembly 190. Starting with a first end of cable 332, cable 332 is routed around pulley 337 which is attached to swivel pulley 120 and then around pulley 338 which is attached to arm assembly 100. Cable 332 is then routed around pulley 339 which is attached to track assembly 80 and then upward and around fixed pulley 340 then outward and around fixed pulley 341. Cable 332 is then routed downward and around pulley 342 in weight stack pulley 335 then upward and around fixed pulley 343. Cable 332 is then routed downward and around pulley 344 in weight stack pulley bracket 335 and then upward and around fixed pulleys 345 and 346. Cable 332 is then routed downward and around fixed pulley 347 and then outward and around fixed pulley 348. Cable 332 is then routed upward and around pulley 349 which is attached to track assembly 80 and then outward and around pulley 350 which is attached to arm assembly 100. This second end of cable 332 is then routed around pulley 351 which is attached to swivel pulley assembly 120 where it remains in a rest position until pulled by a user. Pulley 336 which is attached to swivel pulley assembly 120 serves as a guide pulley when the first end of cable 332 is pulled. Pulley 352 which is attached swivel pulley assembly 120 serves as guide pulley when the second end of cable 332 is pulled.

When the first end or the second end of cable assembly 331 is pulled, weight stack 15 is lifted and a 4 to 1 ratio of resistance is provided to a user. When the first end and the second end of cable assembly 331 are attached together and pulled together, weight stack 15 is lifted and a 2 to 1 ratio resistance is provided to the user. Both cable ends of cable assembly 331 are attachable to one handle assembly 190 because they share one swivel pulley assembly 120 and have the ability to pivot in tandem.

To exercise with exercise apparatus 210, a user will adjust carriage assembly 275 by unlocking locking pin 82 and by relocking locking pin 82 into the desired aperture in track 250 based on the desired starting pulling point of cable end assemblies 200 in cable system 330. The user will also pivotally adjust arm assembly 100 of carriage assembly 275 by unlocking locking pin 88 on track assembly 280 and by relocking locking pin 88 into the desired aperture in locking plate 102 on arm assembly 100 based on the desired starting pulling point of cable end assemblies 200. The user will then select the appropriate amount of resistance from weight stack 15. The user will then select between pulling one end of cable assembly 331 to obtain a 4 to 1 ratio of resistance, or by pulling both ends at the same time by connecting both ends to one handle assembly 190 to obtain a 2 to 1 ratio of resistance. By pulling one end of cable assembly 331 less resistance will be provided and more cable end travel will be available for functional training exercises. By pulling both cable ends at the same time with one handle assembly 190, more resistance will be provided for strength training movements wherein long cable end travel is not needed. Since both ends of cable assembly 331 exit the same swivel pulley assembly 120, they are close enough to one another to connect to one handle assembly 190 as illustrated in FIG. 9. Also, because both cable ends exit the same swivel pulley assembly 120, swivel pulley assembly 120 will pivot in the direction the user pulls both ends along with handle assembly 190. The user will then pull handle assembly 190 to perform one of many known exercises in the art.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. Alternate carriage assemblies and tracks could be used such as carriage assemblies that track on roller wheels or roller bearings. Also, each cable end assembly could have its own respective handle assembly, one handle assembly could attach to either cable end assembly, or one handle assembly could attach to one or both cable end assemblies together to provide an additional ratio of resistance. Also, a handle assembly could specifically attach to one cable end assembly and a handle assembly could specifically attach to multiple cable end assemblies.

Figure 10:
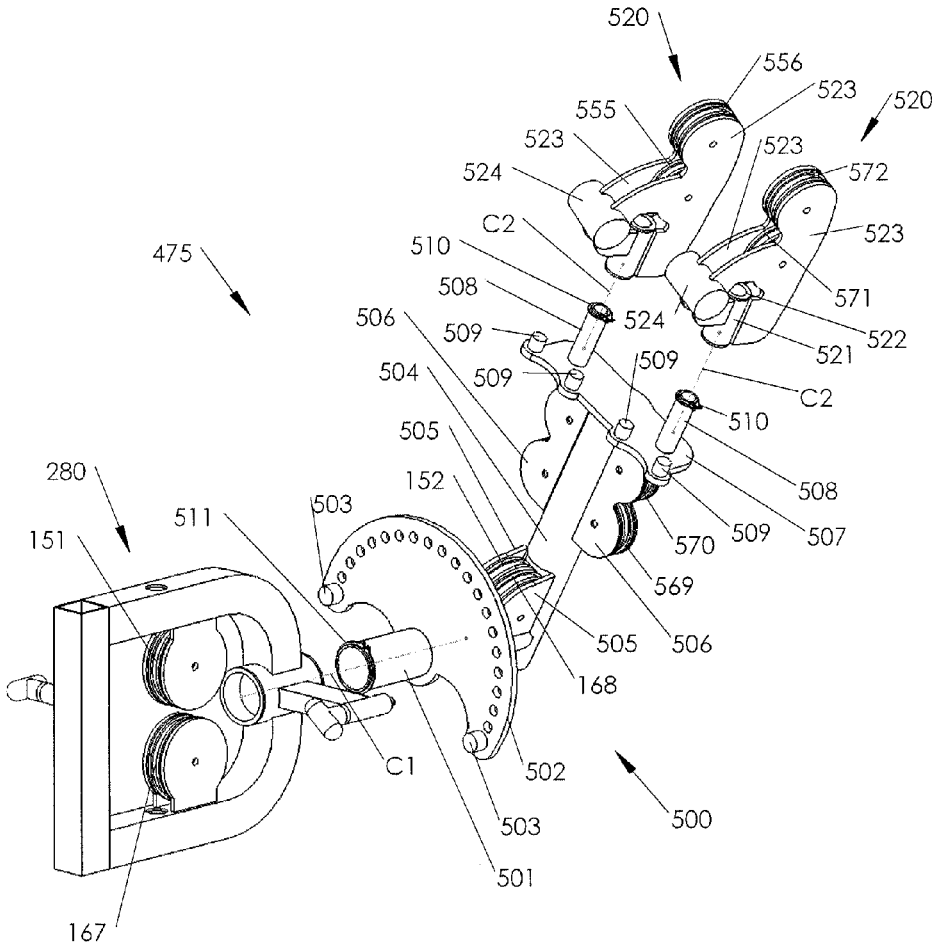
FIG. 10 is a perspective view illustrating an alternate embodiment adjustable carriage assembly including two swivel pulley assemblies.

FIG. 10 illustrates an exploded view of an alternate embodiment carriage assembly which is generally indicated by the numeral 475 and which includes track assembly 280, arm assembly 500, and swivel pulley assemblies 520. Carriage assembly 475 is similar to carriage assembly 275 however is configured for two cable ends to individually exit its own respective swivel pulley assembly rather than having two cable ends exit the same swivel pulley assembly. A similar cable routing is taught in FIGS. 23-27 in U.S. patent application Ser. No. 12/019,174 filed Jan. 24, 2008, now U.S. Pat. No. 8,096,926, wherein Roger Batca is the inventor.

Track assembly 280 is described in detail in paragraph 58. An arm assembly 500, as shown in FIG. 10, comprises side pivot tube 501 wherein a first end provides the pivot point for mounting arm assembly 500 onto bushings 86 of bushing tube 85 on track assembly 280 and is rotatable about an axis labeled C1. Extension tube 504 is attached near the other end of side pivot tube 501 and pulley plates 505 are attached in the corner where extension tube 504 and side pivot tube 501 meet. Pulley plates 505 secure pulleys 152 and 168. A locking plate 502, with apertures formed therein, is attached near the middle of side pivot tube 501. Locking pin 88 of track assembly 80 engages the desired aperture of locking plate 102 to secure the arm assembly 500 into the desired position. Bumpers 503 are attached generally at opposite sides of locking plate 102 and bumper against locking pin 88 of track assembly 280 to prevent over rotation of arm assembly 500. Pulley plates 506 are attached near the distal end of extension tube 504 and secure pulleys 553 (not shown), 554 (not shown), 569, and 570. Base plate 507 is attached to the distal end of extension tube 504 and secures axles 508 wherein respective swivel pulley assemblies 520 are attached and rotatable about respective axes labeled C2. Bumpers 509 are attached to base plate 507 and prevent over rotation of respective swivel pulley assemblies 520. Retaining rings 510 secure respective swivel pulley assemblies 520 to the arm assembly 500. Retaining ring 511 secures arm assembly 500 onto bushing tube 85 of track assembly 80.

Each swivel pulley assembly 520, as shown in FIG. 10, is pivotally attached to arm assembly 500 and is rotatable about a respective axis labeled C2. Each respective swivel pulley assembly 520 comprises bushing tube 521 which includes respective bushings 522 at each end and which provides the pivot point for mounting onto extension tube 504. Each swivel pulley assembly 520 also includes pulley plates 523, which are attached to bushing tube 521, and which also secure respective pulleys 555, 556, 571, and 572. Each swivel pulley assembly 520 includes counter weight 524 which is attached to pulley plates 523 and which balances the weight of the swivel pulley assembly 520 about axis C2.

It is not shown in the drawings, however, this alternate embodiment carriage assembly 475 could include storage capability so that each swivel pulley assembly 520 would not freely pivot about respective axes C2 when not in use. For example, velcro could be attached to each swivel pulley assembly 520 as well as the arm assembly 500 so that the swivel pulley assembly 520 not in use could be rotated until velcro of each assembly engaged one another to put the respective swivel pulley assembly 520 in a storage position. Also, a locking pin rather than velcro could be used to store each swivel pulley assembly 520.

Figure 11:
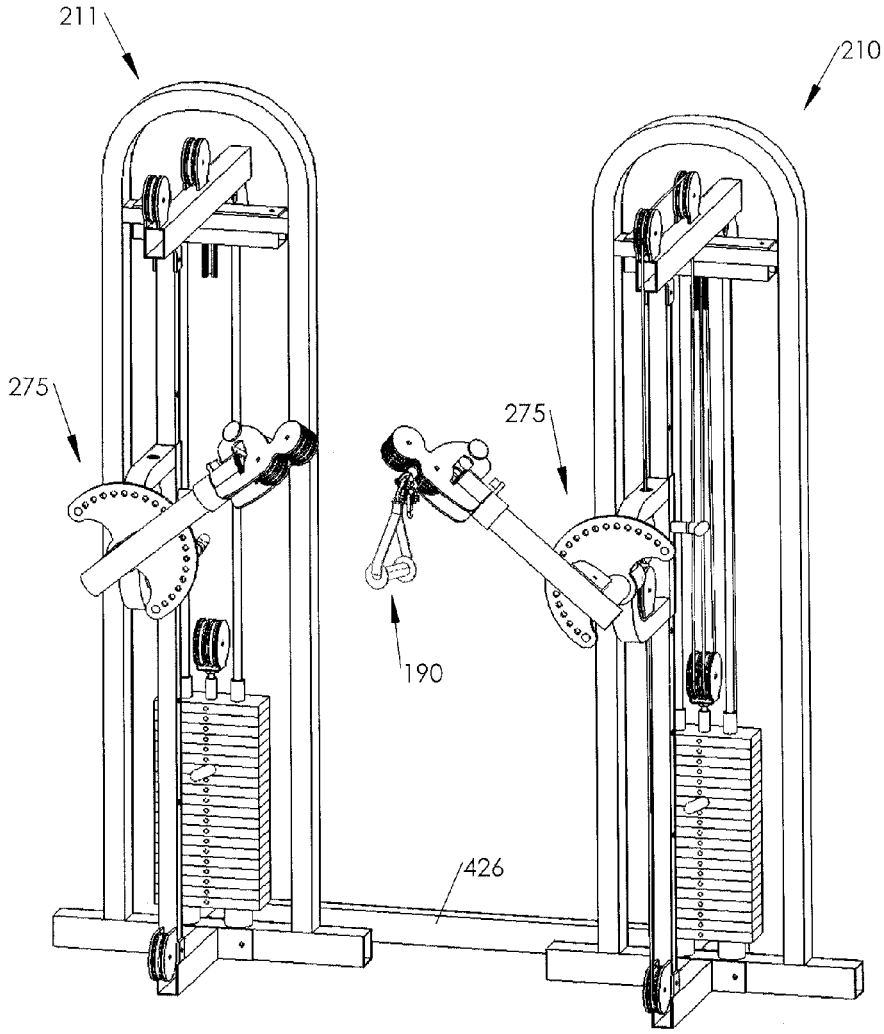
FIG. 11 is a perspective view illustrating an embodiment of two exemplary exercise apparatus's combined into one exercise apparatus.
Figure 11:
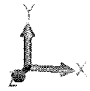

FIG. 11 illustrates an alternate embodiment exercise apparatus comprising an exercise apparatus 210 and an exercise apparatus 211 connected at the bottom with frame bottom 426. Exercise apparatus 211 is a mirror image of exercise apparatus 210 (cable system 130 and handle assembly 190 is not shown). This embodiment allows a user to vary the height and the distance between left and right versions of the above described invention and would increase the number of functional and strength training exercises known in the art that a user could perform.

Also, those skilled in the art will appreciate that some aspects of some of the above mentioned embodiments can be combined within one another. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a frame, said frame including or connected with at least one track;

a resistance element to provide resistance for performing exercise;

a carriage assembly adjustable to multiple fixed positions along said track, said carriage assembly including a track assembly, an arm assembly pivotally mounted and pivotally adjustable to multiple fixed positions, and a swivel pulley assembly pivotally mounted to said arm assembly and including at least two pulleys;

a flexible connector system coupled to said resistance element and comprising two or more flexible lines, said flexible connector system including a first, second, third, and fourth flexible line end coupled to said carriage assembly, said first and third flexible line ends partially wrapping around and extending beyond respective said pulleys on said swivel pulley assembly and maintaining respective rest positions until pulled;

at least one handle; and wherein said flexible connector system is configured to provide a first ratio of resistance when said at least one handle is attached to said first flexible line end and pulled by a user, and to provide a second ratio of resistance different and greater than said first ratio of resistance when said at least one handle is attached to said third flexible line end and pulled by said user, said first flexible line end and said third flexible line end being adjustable to multiple fixed positions along said track and adjustable to multiple fixed positions along a curved path when said arm assembly is pivotally adjusted, and wherein said swivel pulley assembly pivots in the direction said first and third flexible line ends are pulled.

2. The exercise apparatus of claim 1 wherein a first said flexible line includes said first and second flexible line ends and a second said flexible line includes said third and fourth flexible line ends.

3. The exercise apparatus of claim 1 wherein said first flexible line end has at least one foot more travel distance capability when pulled to the maximum distance allowed by said exercise apparatus than said third flexible line end when pulled to the maximum distance allowed by said exercise apparatus.

4. The exercise apparatus of claim 1 wherein said two or more flexible lines are cable.

5. An exercise apparatus comprising:

a frame, said frame including or connected with at least one track;

a resistance element to provide resistance for performing exercise;

a carriage assembly adjustable to multiple fixed positions along said track, said carriage assembly including a track assembly, an arm assembly pivotally mounted and pivotally adjustable to multiple fixed positions, and a first and a second swivel pulley assembly pivotally mounted to said arm assembly, said first swivel pulley assembly including a first pulley and said second swivel pulley assembly including a second pulley;

a flexible connector system coupled to said resistance element and comprising two or more flexible lines, said flexible connector system including a first, second, third, and fourth flexible line end coupled to said carriage assembly, said first flexible line end partially wrapping around and extending beyond said first pulley on said first swivel pulley assembly and maintaining a rest position until pulled and said third flexible line end partially wrapping around and extending beyond said second pulley on said second swivel pulley assembly and maintaining a rest position until pulled;

at least one handle; and wherein said flexible connector system is configured to provide a first ratio of resistance when said at least one handle is attached to said first flexible line end and pulled by a user, and to provide a second ratio of resistance different and greater than said first ratio of resistance when said at least one handle is attached to said third flexible line end and pulled by said user, said first flexible line end and said third flexible line end being adjustable to multiple fixed positions along said track and adjustable to multiple fixed positions along a curved path when said arm assembly is pivotally adjusted, and wherein said first swivel pulley assembly pivots in the direction said first flexible line end is pulled and said second swivel pulley assembly pivots in the direction said third flexible line end is pulled.

6. The exercise apparatus of claim 5 wherein a first said flexible line includes said first and second flexible line ends and a second said flexible line includes said third and fourth flexible line ends.

7. The exercise apparatus of claim 5 wherein said first flexible line end has at least one foot more travel distance capability when pulled to the maximum distance allowed by said exercise apparatus than said third flexible line end when pulled to the maximum distance allowed by said exercise apparatus.

8. The exercise apparatus of claim 5 wherein said two or more flexible lines are cable.

9. The exercise apparatus of claim 5 including velcro to engage and secure a respective swivel pulley assembly in a storage position so as to not interfere with the other swivel pulley assembly when in use.

10. The exercise apparatus of claim 5 including a locking pin to secure a respective swivel pulley assembly in a storage position so as to not interfere with the other swivel pulley assembly when in use.

11. An exercise apparatus comprising:

a frame, said frame including or connected with at least one track;

a resistance element to provide resistance for performing exercise;

a carriage assembly adjustable to multiple fixed positions along said track, said carriage assembly including a track assembly, an arm assembly pivotally mounted and pivotally adjustable to multiple fixed positions, and a swivel pulley assembly pivotally mounted to said arm assembly and including at least two pulleys;

a flexible connector system coupled to said resistance element and comprising at least one flexible line, said flexible connector system including a first and a second flexible line end coupled to said carriage assembly, said first and second flexible line ends partially wrapping around and extending beyond respective said pulleys on said swivel pulley assembly and maintaining respective rest positions until pulled;

at least one handle; and wherein said flexible connector system is configured to provide a first ratio of resistance when said at least one handle is connected to said first flexible line end and pulled by a user, and to provide a second ratio of resistance different and greater than said first ratio of resistance when said at least one handle is connected to both said first and second flexible line ends and pulled by said user, said first flexible line end and said second flexible line end being adjustable to multiple fixed positions along said track and adjustable to multiple fixed positions along a curved path when said arm assembly is pivotally adjusted, and wherein said swivel pulley assembly pivots in the direction said first and second flexible line ends are pulled.

12. The exercise apparatus of claim 11 wherein said at least one flexible line is cable.

* * * * *